US009139962B2

(12) United States Patent
Smith

(10) Patent No.: US 9,139,962 B2
(45) Date of Patent: Sep. 22, 2015

(54) REMOVABLE DOWEL CONNECTOR AND SYSTEM AND METHOD OF INSTALLING AND REMOVING THE SAME

(71) Applicant: The Fort Miller Co., Inc., Greenwich, NY (US)

(72) Inventor: Peter Smith, Gansevoort, NY (US)

(73) Assignee: The Fort Miller Co., Inc., Greenwich, NY (US)

( * ) Notice: Subject to any disclaimer, the term of this patent is extended or adjusted under 35 U.S.C. 154(b) by 0 days.

(21) Appl. No.: 14/091,734

(22) Filed: Nov. 27, 2013

(65) Prior Publication Data

US 2014/0086682 A1 Mar. 27, 2014

Related U.S. Application Data

(62) Division of application No. 13/672,421, filed on Nov. 8, 2012.

(60) Provisional application No. 61/557,393, filed on Nov. 8, 2011.

(51) Int. Cl.

| | |
|---|---|
| ***E01C 23/00*** | (2006.01) |
| ***E01C 11/00*** | (2006.01) |
| ***E04B 1/41*** | (2006.01) |
| ***E04C 2/06*** | (2006.01) |
| ***E01C 11/02*** | (2006.01) |
| ***E01C 7/14*** | (2006.01) |
| ***E01C 11/14*** | (2006.01) |
| ***E01C 23/06*** | (2006.01) |

(Continued)

(52) U.S. Cl.

CPC ..... *E01C 11/005* (2013.01); *E01C 7/147* (2013.01); *E01C 11/02* (2013.01); *E01C 11/06* (2013.01); *E01C 11/14* (2013.01); *E01C 23/00* (2013.01); *E01C 23/06* (2013.01); *E01C 23/09* (2013.01); *E04B 1/41* (2013.01); *E04C 2/06* (2013.01)

(58) Field of Classification Search

CPC ..... E04F 15/22; E01C 7/147; E01C 11/02; E01C 11/005; E01C 11/06; E01C 11/14; E01C 23/00; E01C 23/06; E01C 23/09; E04B 1/41; E04C 2/06

USPC ..... 404/72, 75, 78, 47, 60

See application file for complete search history.

(56) References Cited

U.S. PATENT DOCUMENTS

| | | | | |
|---|---|---|---|---|
| 2,508,443 | A | 5/1950 | Carter | |
| 2,575,247 | A | 11/1951 | Carter | |
| 2,794,336 | A * | 6/1957 | Ballou | 52/705 |

(Continued)

*Primary Examiner* — Raymond W Addie

(74) *Attorney, Agent, or Firm* — Schmeiser, Olsen & Watts LLP

(57) ABSTRACT

A pre-fabricated pavement slab installation and replacement system is provided. The system includes a connector having an axial opening therethrough and engagement surface within the opening. The system further includes a pavement slab and an adjacent pavement slab, wherein a portion of the connector is embedded in the pavement slab and a remaining portion of the connector is exposed. The adjacent pavement slab has an interconnection slot, that can cover the remaining portion of the exposed connector. The system further provides that under the condition that the pavement slab and the adjacent pavement slab are cut apart, the connector is cut into a first half and a second half, wherein the first half of the connector contains the first engagement component and the second half of the connector contains the second engagement component. The first half of the connector can be subsequently removed by engaging the engagement surface.

17 Claims, 10 Drawing Sheets

(51) Int. Cl.
*E01C 11/06* (2006.01)
*E01C 23/09* (2006.01)

(56) References Cited

U.S. PATENT DOCUMENTS

| | | | | | |
|---|---|---|---|---|---|
| 4,449,844 | A | | 5/1984 | Larsen | |
| 4,883,385 | A | | 11/1989 | Kaler | |
| 5,216,862 | A | | 6/1993 | Shaw et al. | |
| 5,366,319 | A | | 11/1994 | Hu et al. | |
| 5,487,249 | A | | 1/1996 | Shaw et al. | |
| 5,492,431 | A | | 2/1996 | Rasmussen et al. | |
| 5,674,028 | A | | 10/1997 | Norin | |
| 5,682,635 | A | * | 11/1997 | Tolliver et al. | 14/14 |
| 5,713,174 | A | | 2/1998 | Kramer | |
| 5,797,231 | A | | 8/1998 | Kramer | |
| 6,171,106 | B1 | | 1/2001 | Kaneko et al. | |
| 6,389,774 | B1 | | 5/2002 | Carpenter | |
| 6,471,441 | B1 | | 10/2002 | Muller | |
| 6,595,718 | B2 | * | 7/2003 | Smith | 404/99 |
| 6,752,566 | B2 | * | 6/2004 | Smith | 404/75 |
| 6,758,023 | B1 | | 7/2004 | Sorkin | |
| 6,953,303 | B1 | | 10/2005 | Chase et al. | |
| 7,201,535 | B2 | | 4/2007 | Kramer | |
| 7,314,333 | B2 | | 1/2008 | Shaw et al. | |
| 7,441,984 | B2 | | 10/2008 | Kramer | |
| 8,591,143 | B1 | * | 11/2013 | Knapp | 404/99 |
| 2005/0265802 | A1 | | 12/2005 | Miller et al. | |
| 2006/0117678 | A1 | * | 6/2006 | Neighbours | 52/125.1 |
| 2006/0127179 | A1 | | 6/2006 | Nadler | |
| 2009/0060655 | A1 | | 3/2009 | Nadler | |
| 2011/0225908 | A1 | | 9/2011 | Nadler | |

* cited by examiner

REMOVABLE DOWEL CONNECTOR AND SYSTEM AND METHOD OF INSTALLING AND REMOVING THE SAME

CROSS REFERENCE TO RELATED APPLICATION[S]

This application is a divisional application of the earlier U.S. Utility patent application to Smith entitled "REMOVABLE DOWEL CONNECTOR AND SYSTEM AND METHOD OF INSTALLING AND REMOVING THE SAME," Ser. No. 13/672,421, filed Nov. 8, 2012, now pending, which claims priority to U.S. Provisional Patent Application to Smith entitled "PRE-FABRICATED PAVEMENT SLAB, PAVEMENT SLAB SYSTEM, AND METHOD OF INSTALLING AND REMOVING SAME," Ser. No. 61/557,393, filed Nov. 8, 2011, the disclosures of which are hereby incorporated entirely herein by reference.

BACKGROUND

1. Technical Field

The following relates generally to roadway construction and repair, and more particularly, to the formation, installation and system for replacing and/or intermittent repair of a pre-fabricated pavement slab, and the slab so formed.

2. State of the Art

Many of our vital utilities such as water, sewer, storm and gas lines, telephone and other communication cables, heating and cooling lines are buried underground to keep them out of harm's way and protected from the elements. While many of these were wisely installed outside of highway pavement areas, to facilitate access for repair or replacement purposes, many more were not because there were no available alternative locations.

Under-pavement utilities are particularly common in cities where there is no other space to locate them.

Repair of under-pavement utilities inherently involves removal and replacement of the pavement above the utility. The process typically involves sawing the existing pavement along the boundaries of the trench, removal of the pavement and the earth below it, repair of the utility, backfilling the excavated material and finally, restoring the pavement to its original condition.

Acceptable restoration of pavement over utility trenches in heavily traveled areas, such as city intersections, has been an age-old problem. Not only is the backfilling process often done hastily but the pavement is frequently replaced with "flexible" asphalt pavement. When the poorly-compacted backfill settles, the pavement follows leaving "classic" bumps at such locations.

A proper restoration of concrete pavement that has been removed for utility repair requires insertion of load transfer dowels to transfer load across joints between adjacent slabs of the new concrete pavement. Properly inserting dowels in replacement pavement is a laborious and time consuming process that is sometimes omitted in heavily traveled areas, in the interest of limiting repair time, which omission may result in a concrete "patch" that may, and often does, settle as the newly installed backfill over the utility settles.

An alternative to sawing the pavement for a "specific" trench directly over the utility is to remove entire pavement slabs that have been placed in the general vicinity of the desired trench. This is done by cutting the dowels in the existing joints around the slab or slabs that are to be removed to free it up for removal. Once removed, the utility may be repaired. Prior to installing new cast-in-place pavement the current practice is to drill holes for new dowels in the edges of the surrounding existing pavement with a drill or other boring device. The current practice is to drill holes for the new dowels slightly offset from the original dowels which were cut in half in the removal process and remain in the existing pavement. This time-consuming process is necessary since it is extremely difficult to remove the half of the original, typically solid, steel, dowel. This practice also compromises the structural integrity of the edges of the existing pavement because holes for dowels now exist at 6 inch rather than at 12 inch centers.

Accordingly, there exists a need in the industry for a precast pavement slab and a method of installing the slab that solves these and other problems.

SUMMARY

The following relates to roadway construction and repair, and more particularly, to the formation, installation and system for replacing and/or intermittent repair of existing concrete pavement or of a previously-placed pre-fabricated pavement slab, and the slab so formed.

A first general aspect relates to a connector for placement in adjacent pavement slabs, the connector being configured to couple the adjacent slabs. The connector comprises a dowel having an axial opening therethrough, and engagement components fixedly coupled to the dowel within the opening, wherein a portion of the dowel is embedded in one pavement slab and a remaining portion of the dowel is embedded in an adjacent pavement slab.

Another general aspect relates to a first engagement component that may be positioned in the opening such that the first engagement component resides in the portion of the dowel that is embedded in the one pavement slab. A second engagement component may be positioned in the opening such that the second engagement component resides in the remaining portion of the dowel that is embedded in the adjacent pavement slab.

Another general aspect relates to the engagement component being a threaded bolt nut.

Another general aspect relates to the dowel being a cylindrical steel bar having the opening therethrough.

Another general aspect relates to the engagement component being fixedly attached to the opening.

Another general aspect relates to a system for installing and removing a connector in adjacent pavement slabs, wherein the system comprises a connector having an axial opening therethrough and engagement components fixedly coupled to the connector within the opening. The system further comprises a pavement slab, wherein a portion of the connector is embedded in the pavement slab and a remaining portion of the connector is exposed, and an adjacent pavement slab having an interconnection slot, wherein under the condition that the adjacent pavement slab is positioned adjacent the pavement slab, a joint is established therebetween and the interconnection slot covers the remaining portion of the exposed connector. The system further comprises a binder material, the binder material being inserted into the interconnection slot to bind the remaining portion of the connector to the adjacent pavement slab.

Another general aspect relates to a first engagement component being positioned in the opening such that the first engagement component resides in the portion of the connector that is embedded in the pavement slab, and a second engagement component being positioned in the opening such that the second engagement component resides in the remaining portion of the connector that is within the interconnection slot of the adjacent pavement slab.

Another general aspect relates to, wherein under the condition that the pavement slab and the adjacent pavement slab are cut along the joint, the connector is cut into a first half and a second half, wherein the first half of the connector contains the first engagement component and the second half of the connector contains the second engagement component.

Another general aspect relates to, wherein under the condition that the adjacent pavement slab is vertically moved away from the pavement slab, the axial opening of the first half of the connector is exposed.

Another general aspect relates to an engagement mechanism, wherein the engagement mechanism is configured to reach within the exposed axial opening of the first half of the connector to engage the first engagement component.

Another general aspect relates to the engagement between the engagement mechanism and the engagement component facilitating the removal of the first half of the connector from the pavement slab, leaving a space in the pavement slab, the space being defined by the shape of the removed connector.

Another general aspect relates to the engagement component being a coil bolt nut and the engagement mechanism being a coil bolt. As the coil bolt is threaded through the nut, the distal end of the coil bolt contacts a terminal end of the space, which prevents further axial advancement of the coil bolt, which causes the nut and the first half of the connector coupled thereto to axially retreat from the space.

Another general aspect relates to a full replacement connector being inserted and secured within the space, such that a portion of the full replacement connector is embedded in the pavement slab and a remaining portion is exposed.

Another general aspect relates to a method of vertically removing and replacing a pavement slab, the method comprising, cutting along a joint between a pavement slab and an adjacent pavement slab, wherein the cutting along a joint cuts a connector positioned between the pavement slab and the adjacent pavement slab into two parts, vertically removing the adjacent pavement slab to expose the part of the connector in the pavement slab, removing the part of the connector from the pavement slab, installing a new connector in the place of the part of the connector in the pavement slab; and replacing the adjacent pavement slab.

Another general aspect relates to the step of removing the part of the connector from the pavement slab further comprising inserting an engagement mechanism into a central opening in the part of the connector, engaging an engagement component positioned in the central opening with the engagement mechanism, and operating the engagement mechanism to remove the part of the connector from the pavement slab without damaging the pavement slab.

Another general aspect relates to the step of installing a new connector in the place of the part of the connector in the pavement slab further comprising placing a binder material between the new connector and the pavement slab, and inserting the new connector into a space created in the pavement slab by the removal of the part of the connector from the pavement slab.

Another general aspect relates to the step of replacing the adjacent pavement slab further comprising removing the part of the connector from the adjacent pavement slab, cleaning out an interconnection slot in the adjacent pavement slab, and replacing the adjacent pavement slab by placing the adjacent pavement slab with the newly cleaned-out interconnection slots over the new connector in the pavement slab.

Another general aspect relates to the step of the replacing the adjacent pavement slab further comprising installing a new pavement slab in the place of the adjacent pavement slab, wherein the new adjacent pavement slab is configured to couple to the new connectors of the pavement slab.

Another general aspect relates to the step of the engaging an engagement component positioned in the central opening with the engagement mechanism further comprising threading the engagement mechanism into the threads of the engagement component until the engagement mechanism engages the pavement slab and causes the engagement component to axially withdraw down the threads of the engagement mechanism, which in turn causes the part of the connector, which is fixedly coupled to the engagement component, to remove from the pavement slab without damaging the pavement slab.

Another general aspect relates to a method of replacing a connector in pavement, the method comprising cutting the pavement slab to a depth to cut a connector in the pavement slab into first and second parts, the cutting the pavement slab defining first and second adjacent slabs, removing the second adjacent slab having the second part contained therein from beside the first adjacent slab to define a void and thereby expose the first part of the connector in the first adjacent slab, removing the first part of the connector from the first adjacent slab without otherwise damaging the first adjacent slab, installing another connector in the first adjacent part wherefrom the first connector was removed, the another connector extending from the first adjacent part into the void, and replacing the second adjacent part in the void next to the first adjacent part.

Another general aspect relates to inserting an engagement mechanism into an opening in the first part of the connector and operating the engagement mechanism to remove the first part of the connector from the first adjacent slab without damaging the first adjacent slab.

Another general aspect relates to placing the second adjacent part in structural communication with the another connector extending from the first adjacent part and fixedly engaging the second adjacent part with the another connector.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
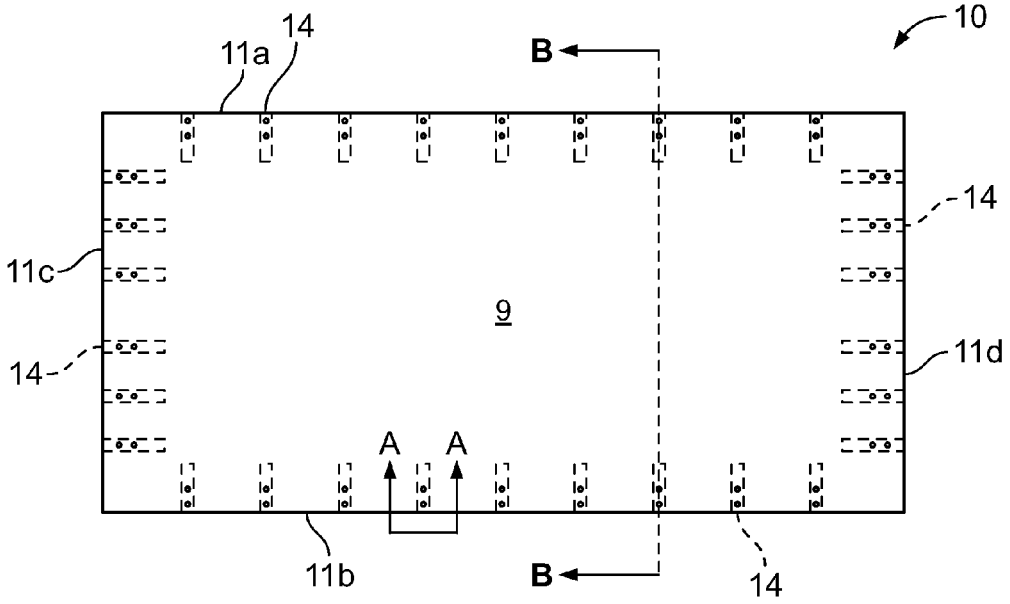
FIG. 1 depicts a top plan view of an embodiment of a pre-fabricated slab in accordance with the present disclosure.

Referring to the drawings, FIG. 1 depicts a plan view of a pre-fabricated pavement slab 10. The slab 10 may be constructed by pouring a pavement material, such as concrete, or other similarly used material, into a form and left to set. The slab 10, once hardened, may be used in high-traffic areas, such as highways, on/off ramps, airport runways, toll booth areas, etc. The pavement slab 10 is approximately 10-12 feet in width W and approximately 16 feet in length L. Embodiments of the slab 10 include the slab being formed 10-12 feet in length and 5-6 feet wide. The slabs 10 may range in thickness T from approximately 8-16 inches. These dimensions, L, W, T, however, may vary as desired, needed or required and are only stated here as an example. The slab 10 may be shipped from one location to another in its pre-fabricated state.

The top surface 9 of the slab 10 may have a roughened astro-turf drag finish, while the sides 11*a* and 11*b*, the ends 11*c* and 11*d*, and bottom surface 7 of the slab 10 have a substantially smooth finish. The side 11*a* or the side 11*b* may be a first edge and the end 11*c* or the end 11*d* may be a second edge. The bottom surface 7, the sides 11*a* and 11*b*, and the ends 11*c* and 11*d* of the slab 10 come together to form a chamfer 15, FIG. 2 around the perimeter of the slab 10. The chamfer 15 prevents soil build-up between two mating slabs which may occur if the slab 10 is tipped slightly during installation. Installation of the slab 10 is performed in a substantially vertical manner, by use of a crane, lift, or other heaving lifting machinery.

Figure 2:
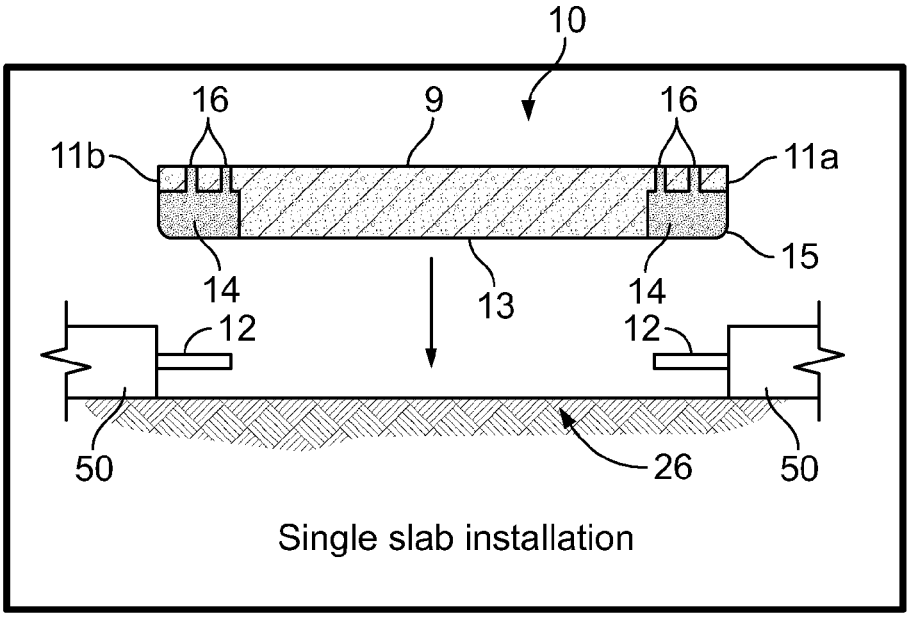
FIG. 2 depicts a cross-sectional view of the pre-fabricated slab taken along line B-B of FIG. 1 in accordance with embodiments of the present disclosure.
Figure 3:
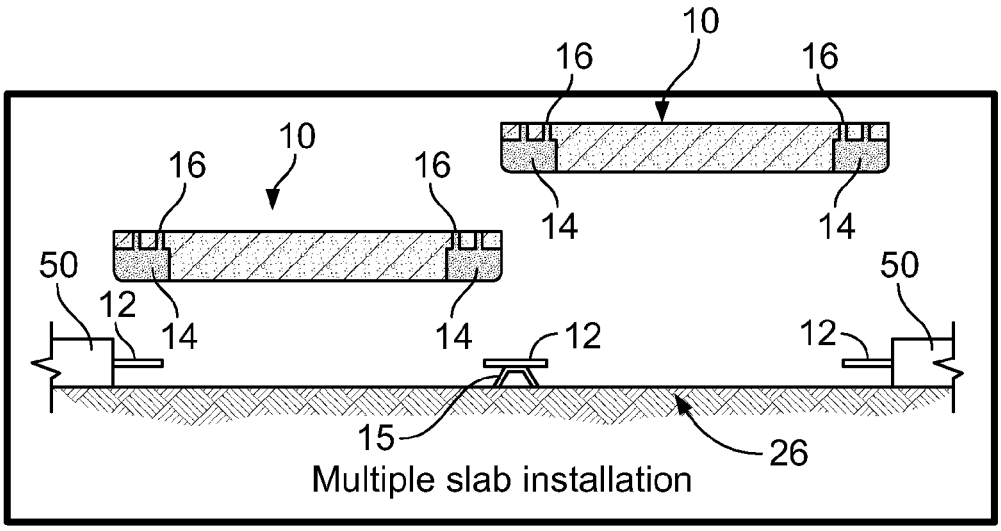
FIG. 3 depicts a cross-sectional view of a series of pre-fabricated slabs being installed in accordance with embodiments of the present disclosure.

Referring to FIG. 2, the slab 10 may further include a plurality of interconnection slots 14 formed within one or more sides 11*a*-11*d* and bottom surface 7 of the slab 10, such as for example, as depicted in FIG. 1. Embodiments of the slab 10 may further include the interconnection slots 14 being configured to receive connectors 12 previously embedded in a pre-existing pavement 50, as depicted in FIG. 2 and as will be described below in greater detail. Embodiments of the slab 10 may further include the interconnection slots 14 being configured to receive connectors 12 positioned previously on a support 15 on a subgrade 26, as depicted in FIG. 3 and as will be described below in greater detail. The pre-existing pavement 50 may comprise sidewalks, roads, highways, freeways, concrete slabs, driveways, garages, parking lots, and the like.

Figure 4:
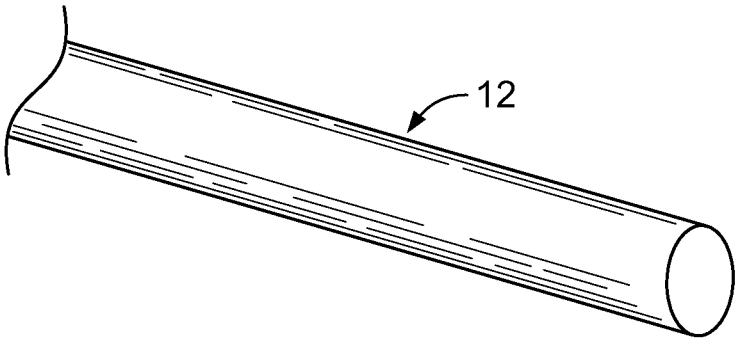
FIG. 4 depicts a partial perspective view of an embodiment of a dowel in accordance with the present disclosure.

Embodiments of the invention include a connector 12 that may comprise a transverse slippable connecting dowel. The dowel may also be referred to as a fastener, connector, key, peg, pin, bar, pole, pipe, conduit, rebar or rod. The connectors 12 may comprise reinforcing steel, such as stainless steel. Each connector 12 may be of standard dimensions, approximately 14-18 inches in length and 1.25-1.5 inches in diameter. The structural capacity of the connector 12 is such that it is sufficient to sustain vertical stresses and loads applied thereto from thermal curling of the pavement slabs and vehicle traffic on the slab 10 and existing pavement 50. In other words, the structural capacity of the connector 12 is sufficient enough to prevent slab 10 and existing pavement 50 from displacing vertically relative to each other in response to the stresses and loads applied thereto. The slippable connectors 12 are mounted truly parallel to the longitudinal axis L of the slab 10 or existing pavement 50 to allow adjacent slabs 10 to expand and contract without inducing unwanted damaging tensile stresses in the slabs 10. The connectors 12 are preferentially mounted such that approximately half of the connector 12 is embedded within the existing pavement 50 and half of the connector 12 extends from the end of the pavement 50 in which the connector 12 is embedded, as depicted in FIG. 2. The slippable connectors allow slabs 10 and existing pavement 50 to expand and contract along the longitudinal axis of the connectors while, at the same time, restraining vertical movement of both slabs 10 and existing pavement 50, relative to each other, as vertical traffic loads traverse across their top surfaces. As depicted in FIG. 4, the connector 12 may be a solid cylindrical dowel that provides strength and rigidity to oppose the vertical loads imposed on the roadway 50 and an adjacent slab 10, and between adjacent slabs 10, from the traffic flowing over the slabs 10 and roadway 50.

As depicted in FIG. 2, the slab 10 may have interconnection slots 14 on opposing sides thereof, the slab 10 being suspended vertically above adjacent roadway 50 on either side of the slab 10 just prior to the vertical insertion of the slab 10 between the adjacent roadway 50. The arrow in FIG. 2 indicates the vertical insertion of the slab 10 on the subgrade 26 between opposing vertical edges of the roadway 50. As illustrated, the connectors 12 in each of the adjacent roadway 50 may be embedded within a side of the adjacent roadway 50 at approximately the midpoint of the thickness T of the roadway 50. The connectors 12 aid in transferring an applied vertical shear load, i.e., from traffic, evenly from one slab 10 to the adjacent roadway 50, without causing damage to the slab 10 or the adjacent roadway 50. Moreover, the connectors 12 restrain vertical movement while allowing expansion and contraction of slab 10 and existing roadway 50. The connectors 12 in each of the adjacent roadway 50 are configured to fit into the corresponding interconnection slots 14 in the slab 10.

However, before the insertion of the slab 10 between the vertical edges of the existing roadway 50, selected portions of the roadway 50 must have been cut and removed to reveal the ground there below. A saw, such as a concrete cutting saw may be used to cut vertically down into the existing roadway 50. The existing roadway 50 is cut to dimensions slightly larger than the dimensions of the slab 10 that is to be placed in the existing roadway 50. Thereafter the roadway material within the cut section of the roadway is removed. Once removed, the ground below the removed portion of the roadway 50 can then be dug up to reveal the damaged utility that needs to be repaired. Repairs are performed on the utility and the repaired sections are backfilled. The subgrade 26 is prepared over the backfilled section. The slab 10 may thereafter be vertically placed between the cut vertical edges of the roadway 50.

Figure 5:
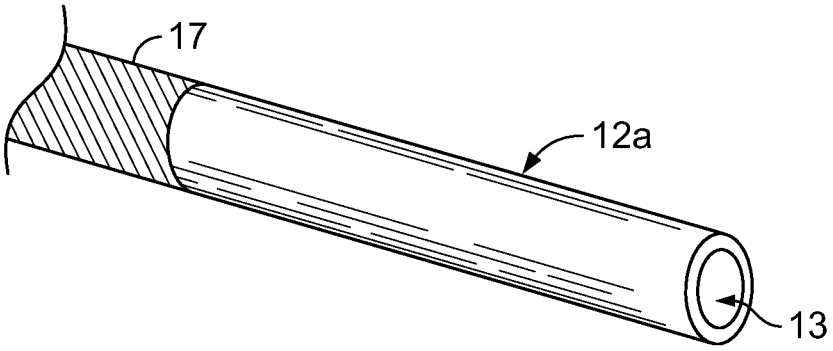
FIG. 5 depicts a partial perspective view of an embodiment of the dowel in accordance with the present disclosure.

To install the slab 10, the connectors 12 may first need to be installed/embedded along the edge of the existing roadway 50 to match interconnection slots 14 in the slab 10. If so, a hole may be drilled within the existing roadway 50, using carbide tipped drill bits, or other similar tools. Thereafter, the connector 12 may be inserted within each hole, along with a binder material 17, such as an epoxy resin, a cement-based or epoxy grout, a polymer foam, etc., as depicted in FIG. 5, to completely fill the annular space between the drilled hole and the connector thereby fully encasing the dowel such that it cannot move vertically in the existing pavement 50 when vertical loads are imposed on the top surfaces of the existing pavement 50 and the slabs 10. Prior to inserting the connectors in the drilled hole, the connectors 12 may be coated with a thin film of bond breaker material such as oil, grease or paraffin compound to render the surfaces of the connectors slippable. The connectors 12 are inserted in the existing roadway 50 in such a way that approximately one half of the connector 12 is coupled within the roadway 50 and the remaining portion of the connector 12 extends from the roadway 50, as depicted in FIG. 3.

The binder material 17 used to bind the connector 12 within the drilled hole in the roadway 50 may be, for example, an epoxy resin, such as Anchor Bond 700 or Anchor Fast #221 from Superior Industries, Inc, or the Sikadur® line of epoxy products from Sika Corporation. However, the binder material may be any commercial epoxy resin that has physical properties and characteristics that allow the binder material to be moldable enough to completely fill the annular space between the drilled hole and the slippable dowel thereby fully encasing the dowel such that it cannot move vertically in the existing pavement 50 when vertical loads are imposed on top surfaces of existing pavement 50 and slabs 10. By virtue of the bond breaker film, applied to the connector 12 prior to insertion of the connector 12, the connector 12 may be removed from existing pavement 50 or slabs 10 without damaging the connector 12 or the pavement 50 or slabs 10. In other words, when mechanical force is exerted to remove the connector 12 from the roadway 50 or from slabs 10, as will be described in greater detail below, the binder material remains in place as an integral part of existing pavement 50 or slabs 10 while the connector 12 is removed.

Figure 14:
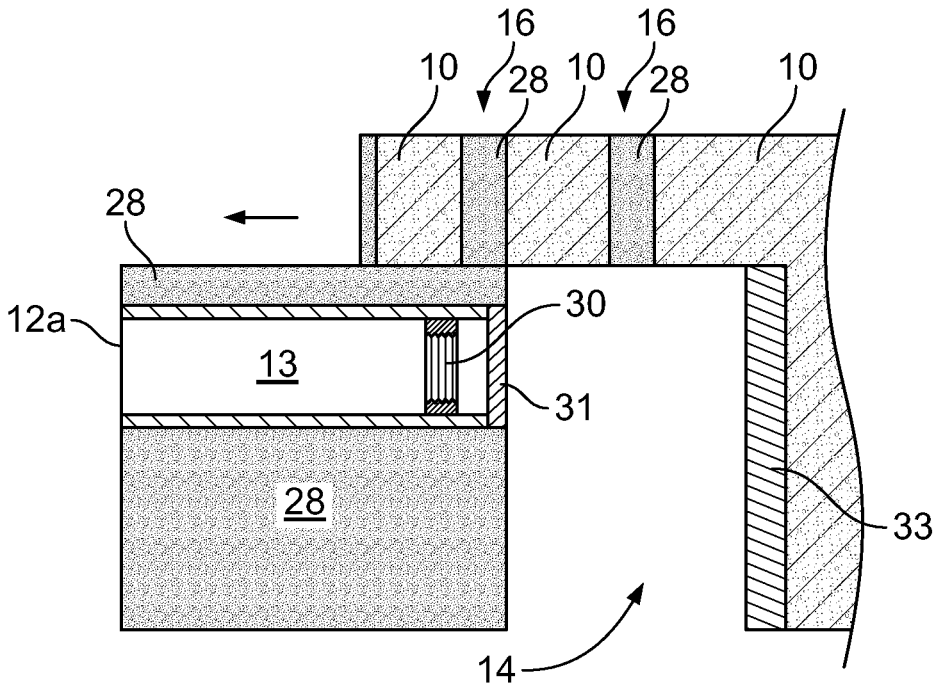
FIG. 14 depicts a cross-sectional view of the dowel and grout plug in the process of being removed from the pre-fabricated slab in accordance with the present disclosure.
Figure 15:
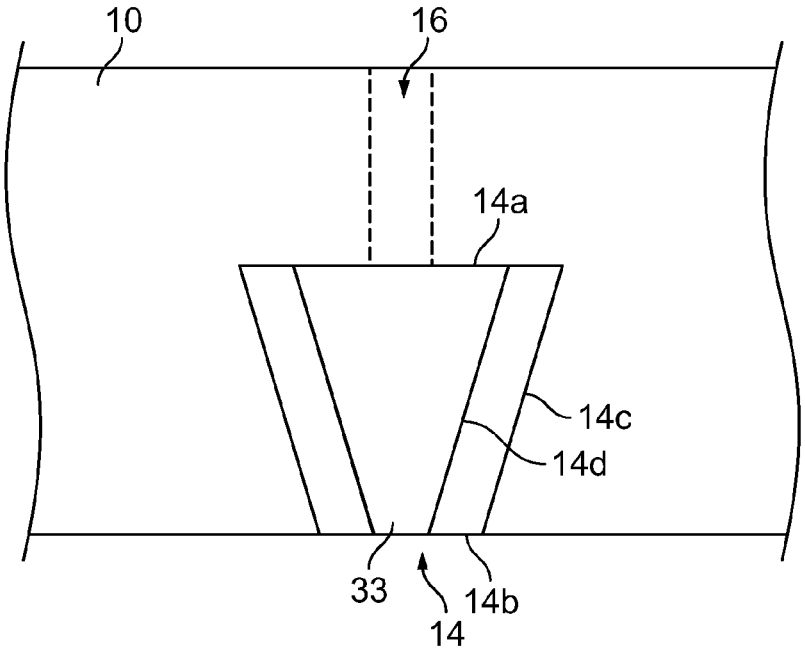
FIG. 15 depicts a side-view of the pre-fabricated slab and an embodiment of the interconnection slot in the pre-fabricated slab taken along line A-A in FIG. 1 in accordance with the present disclosure.
Figure 16:
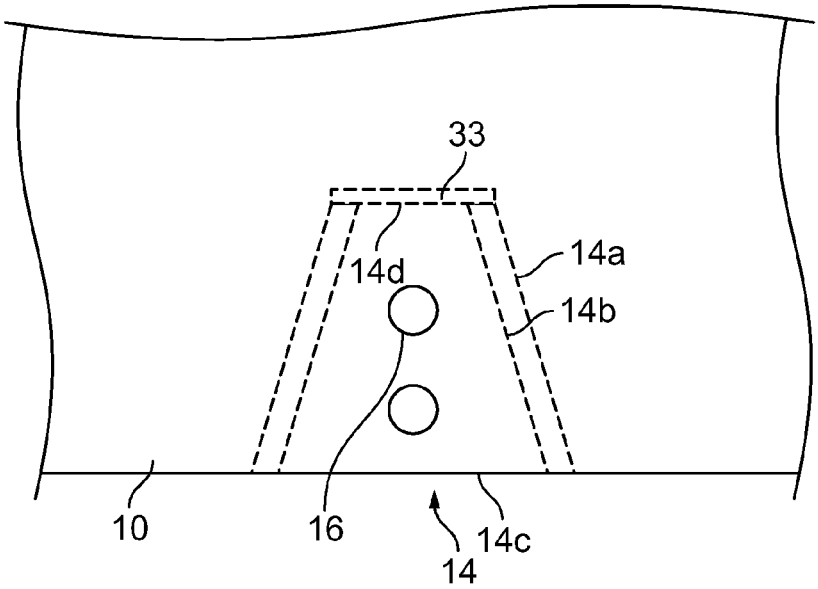
FIG. 16 depicts a partial top-view of the pre-fabricated slab and an embodiment of the interconnection slot in the pre-fabricated slab in accordance with the present disclosure.

Each interconnection slot 14 may be sized to accommodate the connectors 12 extending from the roadway 50 or positioned on the support 15 on the subgrade 26. Once the connectors 12 are accommodated within the slot 14, the slot 14 is filled around the connectors 12 with a binder material 28, such as grout 28, FIG. 8, or expandable foam, thereby forming an interconnection between the slab 10 and the roadway 50 or between adjacent slabs 10. As depicted in FIG. 15, embodiments of the invention further include the interconnection slot 14 being configured wider at the top 14*a* of the slot 14 than at the bottom 14*b* of the slot 14, such that the interconnection slot 14 is wedge-shaped. In other words, the longitudinal sides of the slot 14 are configured to taper from top to bottom to provide the wedge-shape. The wedge-shape functions to prevent the grout 28 surrounding the connector 12 to slide or displace vertically within the slot 14 under applied loads and stresses. Embodiments of the slab 10 further include the interconnection slots 14 being of various shapes, sizes, and widths to prevent the slab 10 from moving with respect to the adjacent slab once the grout 28 has reached sufficient strength, such movement resulting from traffic load or settling of the ground. As depicted in FIG. 16, the interconnection slot 14 is configured to taper from front to back, such that the front 14*c*, located at the edge of slab 10, of the slot 14 is wider than the back 14*d* of the slot. In other words, the longitudinal sides of the slot 14 are configured to taper from front to back. Advantages of the front-to-back taper will be discussed below with regard to removal of the grout 28 from the slot 14, as depicted in FIG. 14.

With reference again to FIGS. 2 and 3, each interconnection slot 14 may further include an opening, access, or port 16. In particular, the binder material 28, such as structural grout or concrete, a polymer foam material, or other similar material, may be injected, or otherwise inserted, within each port 16, thereby filling the interconnection slot 14 that has received the inserted connector 12 to secure slab 10 to the adjacent roadway 50 on each side of the slab 10, or in the alternative to secure slab 10 to adjacent slabs 10 end to end. In other words, once the slab 10 is vertically lowered onto the subgrade 26 that has previously been graded to required specifications and the interconnection slots 14 of the slab 10 surround the connectors 12, the binder material 28 may be injected into the ports 16 to fill the remaining void of the interconnection slot 14 not occupied by the connector 12. Once the binder material 28 sets in the interconnection slot 14 and over and/or around the connector 12, the connectors 12 transfer an applied shear load, i.e., from traffic, slab curling or settling, evenly from one slab 10 to an adjacent slab 10 or from one slab 10 to the adjacent roadway 50, as the case may be, without causing damage to the slab 10 or the adjacent roadway 50.

Figure 17:
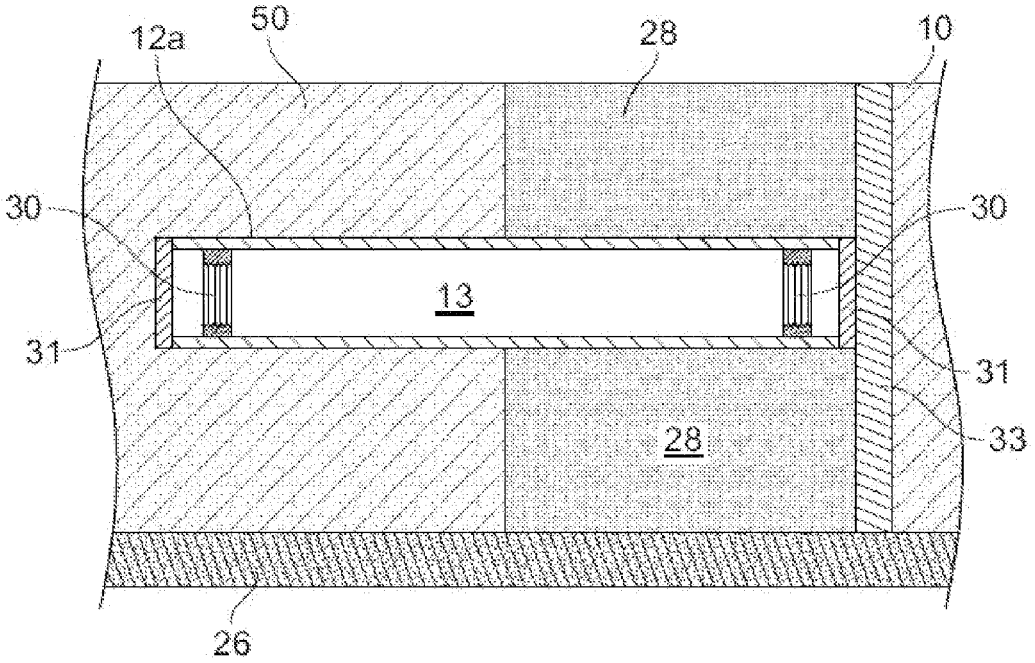
FIG. 17 depicts a cross-sectional view of the dowel partially embedded in each of the existing pavement and an adjacent pre-fabricated slab in accordance with the present disclosure.

In an alternative configuration, the interconnection slot 14 may run through the entire thickness T of the slab 10, such that the interconnection slot 14 may be open to not only the bottom surface of the slab 10 but also the top surface thereof, as depicted in FIG. 17. Thus, similarly to the description above, the binder material 28 may be injected, or otherwise inserted, into the interconnection slot 14 to fill the slot 14 around the connector 12. However, with the interconnection slot 14 open to the top surface of the slab 10, the binder material 28 may be injected, or otherwise inserted, directly into the interconnection slot 14 to fill the area thereof without the need or use of the opening, access, or port 16. In this configuration, despite the interconnection slot 14 running through the entire thickness of the slab 10, the interconnection slot 14 may still be configured to taper from front to back, such that the front 14*c*, located at the edge of slab 10, of the slot 14 is wider than the back 14*d* of the slot 14. In other words, the longitudinal sides of the slot 14 are configured to taper from front to back, as discussed herein, and as depicted in FIG. 15. Also, in this configuration, the interconnection slot 14 may still be configured to be wider at the top 14*a* of the slot 14 (which in this embodiment is also the top of the slab 10) than at the bottom 14*b* of the slot 14, such that the interconnection slot 14 is wedge-shaped. In other words, the longitudinal sides of the slot 14 are configured to taper from top to bottom to provide the wedge-shape, as depicted in FIG. 16.

The slab 10 is placed within the replacement area such that the bottom surface 7 (surface 7 is not labeled in any of the figures) of the slab 10 contacts the subgrade 26 uniformly so as not to disrupt the subgrade 26 or damage the slab 10. During placement, the slab 10 is lowered substantially vertically to the exact location required to match the existing roadway 50, or adjacent slabs 10. Care is taken to insure the interconnection slots 14 are lowered over the connectors 12 extending from the ends and sides of the adjacent roadway 50 or placed on the supports 15 on the subgrade. In particular, as depicted in FIG. 3, a series or a plurality of slabs 10 may be installed over the subgrade 26. The slab 10, or a series of slabs 10, may be set over the subgrade 26 to form the roadway. In this configuration, the interconnection slots 14 of the first slab 10 may be placed over the connectors 12 embedded in the existing roadway 50. Thereafter, the interconnection slots 14 of additional slabs 10 may be placed over the connectors 12 that have been placed on the support 15 on the subgrade 26. Once the slabs 10 have been placed over the subgrade 26, the binder material 28, FIG. 8, such as grout, may be injected/inserted into the ports 16 of the respective slabs 10 to bind each of the slabs 10 to one another and to the existing roadway 50. Embodiments of the invention provide that the binder material, such as concrete or grout, may be injected/inserted up to 48 hours after initial installation of the slabs 10. In this way, the completion of the insertion of the slabs 10 may be done in stages over multiple days/nights to avoid restricting traffic flow over the roadway. For example, the slab 10 may be placed by vertical installation during one night, whereas during the following night, the grout may be injected/inserted into the ports 16 to bind the interconnection slots 14 to the connectors 12 positioned therein.

In addition, instead of preformed slabs 10, a new pavement may be poured over a framework of connectors 12 placed upon supports 15 that have been placed at predetermined intervals along the subgrade 26. In this way, the new pavement may encompass the connectors 12 and the connectors 12 may be positioned at regular intervals in the new pavement. Thereafter, a preliminary cut may be made in the new pavement over the connectors 12 to a depth not to cut the connectors 12, so as to establish a seam along which the new concrete may crack, if needed. Yet, having the connectors 12 below the seam provides sufficient support to transfer an applied shear load, i.e., from traffic, slab curling or settling, evenly across the seam. Then, in the future, should portions of the roadway, i.e., new pavement, need repair, a deeper cut may be made along the chosen seam to cut the connectors 12 to allow removal of the damaged portion of the roadway, as described herein, to allow removal of the connectors 12, as described herein, and to allow the removed roadway to be replaced by one or more prefabricated slabs 10, as described herein.

After these slabs 10 have been placed in the roadway 50 according to the description above, it may become necessary to remove these slabs 10 for repair of utilities underneath them. Under the condition that one or more of these installed slabs 10 must be removed for any number of reasons, such as, but not limited to, repair or replacement of the utility in the ground below the slab 10, the connectors 12 between the slab 10 and the roadway 50, or between adjacent slabs 10, must necessarily be cut by a cutting device, such as a concrete cutter or other similar sawing device, to free the slab 10. Once freed, the slab 10 can be vertically removed, by a crane, excavator, or other vertical lifting device, from its position in the roadway 50 without having to damage, such as by cutting and/or removal, neighboring roadway, slabs, concrete, pavement, etc.

After vertical removal of the slab 10, a replacement slab 10 may then be placed in the vacancy where the slab 10 once was. The replacement slab 10 may be an identically new slab 10 or the very same slab 10 that was just removed from the roadway 50 to conduct the repairs, the replacement of which will be discussed in greater detail below. Regardless of whether a new slab 10 or the very same slab 10 is repositioned in the roadway 50, it is necessary to install new, full-size connectors 12 in the existing roadway 50 surrounding the vacancy, such that the new connectors 12 can reside partially in the roadway 50 and partially within the interconnection slots 14 of the replacement slab 10.

As depicted in FIG. 5, embodiments of the connector 12 may include a connector 12*a* that is a cylindrical dowel having an axial opening 13 therethrough, such that the connector 12*a* is hollow. The axial opening 13 may be an aperture, slot, space, bore, hole, void, or the like. The connector 12*a*, despite having an opening 13 therethrough, is structurally adequate to provide satisfactory resistance to the shear stress/load on the slabs 10, between the existing roadway 50 and the slab 10, and between adjacent slabs 10. In fact, the outer wall of the connector 12*a* has a thickness that is sufficient to sustain the stresses and loads applied thereto from vertical loads imposed by vehicular traffic and by thermal curling of adjacent slab 10 and existing pavement 50. In other words, the thickness of the outer wall of the connector 12*a* is sufficient enough to prevent the hollow connector 12*a* from plastic deformation in response to the stresses and loads applied thereto.

Figure 6:
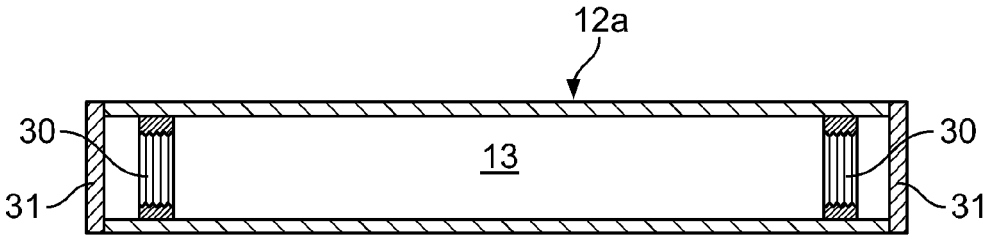
FIG. 6 depicts a cross-sectional view of the dowel in accordance with the present disclosure.

As depicted in FIG. 6, the connector 12*a* may be configured to have an engagement surface or an engagement component 30 coupled to the connector 12*a*. The engagement component 30 may be fixedly coupled to the connector 12*a*. The engagement component 30 may be fixedly coupled within the opening 13 of the connector 12*a*. The engagement component 30 may be press-fit, or otherwise coupled, to the connector 12*a* or within the opening 13 of the connector 12*a*. As illustrated, exemplary embodiments of the connector 12*a* include the engagement component 30 being a threaded bolt nut that is fixedly secured, such as by welding, within the opening 13 at a distance from either distal end of the connector 12*a* or press-fit into the opening at the end of the connector 12*a*. Embodiments of the connector 12*a* may further include the interior of the axial opening 13 being integrally formed with an engageable surface such as a threaded surface, grooved surface, stepped surface or other abrasive surface that holds the engagement component 30 in place to facilitate removal of the connector 12*a* from the existing pavement 50. For example, the interior surface of the axial opening 13, or portions of the interior surface of the axial opening 13, may be threaded such that interior surface of the axial opening 13 is adapted to engage a threaded bolt inserted in the axial opening 13. Also, the interior surface of the axial opening 13 may consist of multi-diameters, such that the internal surface has ridges therein, or is otherwise stepped.

Also, a captive nut may be used which is also known as an insert nut. Captive nuts are threaded inserts with a knurled base that digs into the end of the connector 12*a*.

Another example of the engagement component 30 would be an externally threaded insert. Externally threaded inserts have threads on the outside and inside of the insert. The insert is threaded into a pre-tapped hole, or some inserts tap their own threads in a drilled or molded hole. It is then anchored by various means. A thin walled solid bushing insert by the trademarked name Time-sert® is locked in by rolling the bottom few internal thread into the base material with a special install driver which will permanently lock the insert in place.

Another example of the engagement component 30 would be a helical insert. Helical inserts, more commonly known by the trademark Heli-coil®, are inserts made of coiled wire. The insert is inserted into a tapped hole that is larger than the desired hole. They are usually over-sized so that they anchor themselves.

Another example of the engagement component would be a press fit insert. Press fit inserts are internally threaded and have a knurled outer diameter. They are pressed into a plain hole with an arbor press.

Embodiments of the connector 12*a* may further include a plurality of engagement components 30 that are welded, or otherwise fixedly secured, such as by press fit, compression fit, or friction fit, within the opening 13, wherein each of the engagement components 30 is fixed at a distance from a corresponding distal end of the connector 12*a*. Embodiments of the connector 12*a* further include the engagement component 30 being fixedly secured directly to each distal end of the connector 12*a*.

Embodiments of the connector 12*a* include the engagement component 30 being secured, or otherwise coupled, to the connector 12*a* before insertion of the connector 12*a* in the existing pavement 50 or in the pre-fabricated slab 10. Embodiments of the connector 12*a* include the engagement component 30 being secured, or otherwise coupled, to the connector 12*a* after the connector 12*a* has been cut and remains inside the existing pavement 50 or in the pre-fabricated slab 10. Under conditions that the engagement component 30 is secured, or otherwise coupled, to the connector 12*a* before insertion of the connector 12*a* in the existing pavement 50 or in the pre-fabricated slab 10, securing the engagement component 30 within the axial opening 13 at a distance from the end of the connector 12*a* may prevent concrete, grout, or foam from entering the axial opening 13 and contaminating the engagement component 30, such as the threads of the component, during the embedding of the connector 12*a* in the existing pavement 50 or in a pre-fabricated slab 10. Moreover, embodiments of the connector 12*a* include a cap 31 that may be releasably coupled to the connector 12*a* to prevent ingress of contaminants within the axial opening 13. The cap 31 may be attached to the interior surface, the edge surface, or the outer surface of the connector 12*a*, or any combination of such, so long as the cap 31 can releasably detach from the connector 12*a* upon the application of mechanical force.

Figure 7:
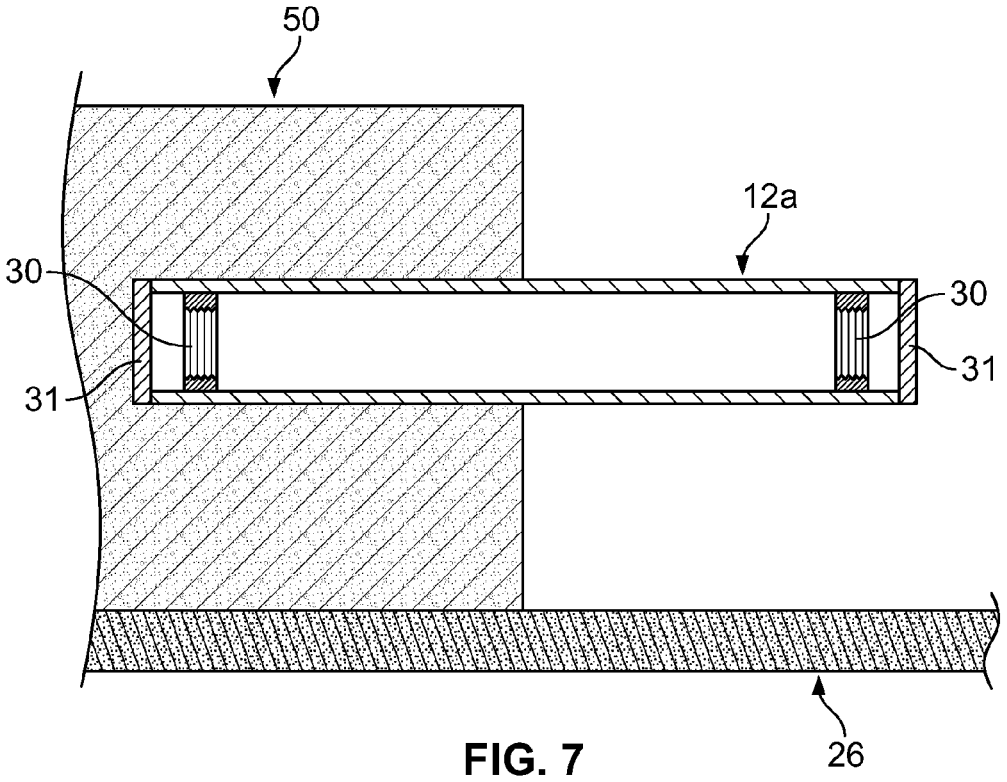
FIG. 7 depicts a cross-sectional view of the dowel partially embedded in the existing pavement in accordance with the present disclosure.

FIGS. 7-11 depict various stages of a system of preparing, installing, and removing a connector 12 from the existing pavement 50. As depicted in FIG. 7, the connector 12*a* can be installed, or otherwise retrofitted, in existing pavement 50. At times, to repair a utility under existing pavement, sections of the existing pavement 50 must be removed to reach the utility, as described above. In these circumstances, the connector 12*a* can be used to transfer shear loads between the existing pavement 50 and the prefabricated slab 10 that will be placed in the section of pavement that was removed to access the utility. To transfer said loads, the existing roadway 50 is retrofitted with the connectors 12*a*. Connectors 12*a* may be inserted, or otherwise retrofitted, into the existing pavement 50 at intervals that correspond to the intervals between corresponding interconnection slots 14 in the slab 10 that will be placed between the existing pavement 50. To retrofit the existing pavement 50, a bore, or opening, may be drilled into the existing roadway 50 and a full-size connector 12*a* may be inserted into the created opening. The full-size connector 12*a* may then be secured within the opening by applying the binder material 17, as depicted in FIG. 5, such as a cement-based or epoxy grout, polymer foam, etc., as described above.

Embodiments of the invention include the connector 12*a* being coated with a coating, or bond breaker, which may be placed on the connector 12*a* prior to insertion within the existing pavement 50. A bond breaker is necessary to prevent the physical bond between the connector 12*a* and the pavement 50 without reducing the functional interaction between the connector 12*a* and the pavement 50. In other words, the bond breaker is not thick enough and does not have deterrent properties that would diminish the physical connection between the pavement 50 and the connector 12*a*. The connector 12*a* must fit securely and snugly within the pavement 50 so that the connector 12*a* can adequately transfer and sustain vertical shear loads, such as from vehicle traffic and thermal curling that act on the pavement 50 and that act between the slab 10 and the existing roadway 50. If the connector 12*a* is not snugly fit or secured within the pavement 50, the connectors 12*a* will not perform their designed function adequately. The bond breaker also allows the connector 12*a* to axially displace within the pavement 50 due to thermal expansion. However, as mentioned above, the bond breaker does not diminish the functional interaction between the connector 12*a* and pavement 50. The bond breaker may be an oil, petroleum or paraffin-based product, such as, but not limited to, Form Oil, such as is known in the art. The bond-breaker may also include paraffin-based products, spray oils, lite-oils, petroleum grease, or the like. The bond breaker may be applied to the connector 12*a* to assist the removal of the connector 12*a*, at a later time, should the connector 12*a* need to be removed, as will be discussed below. Examples of Form Oil include, but are not limited to, Mag 1 from Northern Tool+Equipment or CON-REL-EZE from Petro-Canada.

As depicted in FIG. 7, the connector 12*a* is embedded in the pavement 50, at about the midpoint of the thickness of the pavement 50. Embodiments of the invention further include the connector 12*a* being placed at other locations above or below the midpoint of the thickness of the pavement 50, as needed, but while maintaining structural integrity of the pavement 50 to resist shear loads and stresses. The connector 12*a* is embedded within the pavement 50, such that about one half of the connector 12*a* is embedded in the pavement 50 and the remaining one half of the connector 12*a* protrudes from the pavement 50 and is exposed. Thus, FIG. 7 illustrates the connector 12*a* in a prepared state to receive a neighboring, or adjacent, pre-fabricated slab 10.

Figure 8:
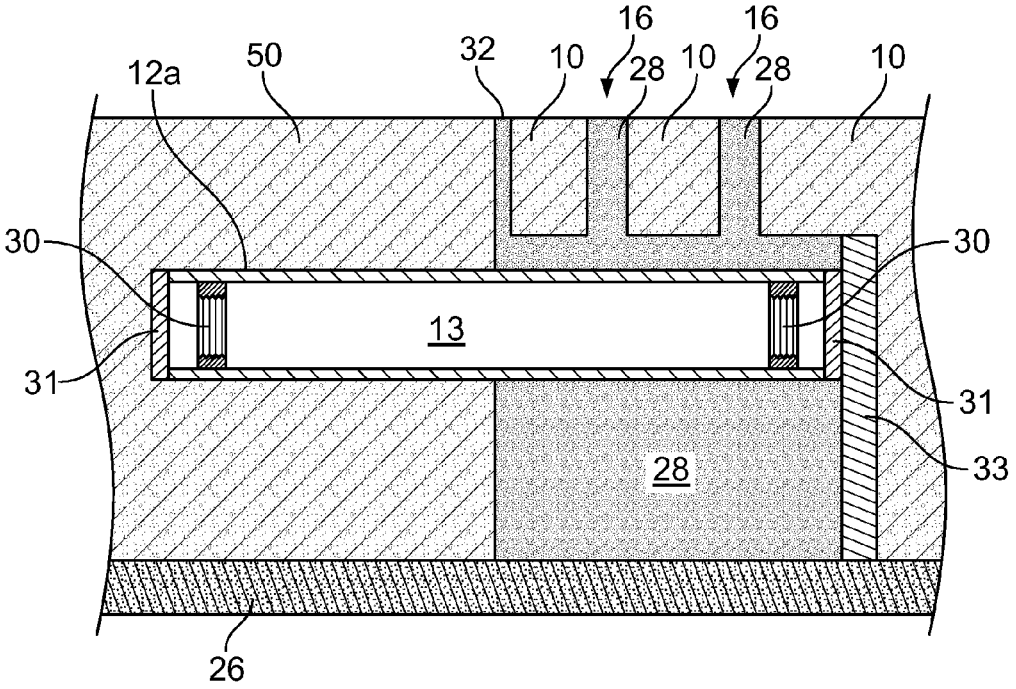
FIG. 8 depicts a cross-sectional view of the dowel partially embedded in each of the existing pavement and an adjacent pre-fabricated slab in accordance with the present disclosure.

Once the connectors 12*a* are inserted in the existing roadway 50, a pre-fabricated slab 10 may be placed over the connectors 12*a* in the roadway 50, the slots 14 are filled with a binder material 28 such that it structurally connects the pre-fabricated slab 10 with the existing roadway 50, as depicted in FIG. 8. Specifically, the pre-fabricated slab 10 is placed on the subgrade 26 such that the various interconnection slots 14 of the pre-fabricated slab 10 are positioned over and encompass the exposed portions of the corresponding connectors 12*a* in the roadway 50. Once in position, the binder material 28 may be injected or otherwise inserted into the ports 16 of the pre-fabricated slab 10 until the binder material 28 fills up the space within the interconnection slot 14 not occupied by the connector 12*a*. Thus, in this configuration, one half of the connector 12*a* is embedded in the existing roadway 50 and the other half of the connector 12*a* is embedded in the pre-fabricated slab 10 via the binder material 28 inserted into the interconnection slot 14 and surrounding the connector 12*a*. A small portion of the binder material fills the joint 32 between the existing roadway 50 and the pre-fabricated slab 10. In embodiments of the connector 12*a* where the engagement components 30 are preinstalled in the connector 12*a*, the engagement components 30 are configured such that one engagement component 30 may be positioned on one side of the joint 32 and another opposing engagement component 30 may be positioned on the other side of the joint 32. In this way, opposing engagement components 30 are positioned on either side of the joint 32. Moreover, embodiments of the connector 12*a* may be further configured such that an engagement surface may be positioned on one side of the joint 32 and another engagement surface may be positioned on the other side of the joint 32.

With reference to FIG. 8, embodiments of the invention further include a void-forming foam spacer 33 being positioned within the interconnection slot 14 at the rear surface of the interconnection slot 14. The spacer 33 may be positioned against the rear surface of the interconnection slot 14 to prevent the grout 28 from adhering to the rear surface. This embodiment aids in the removal of the grout 28 from the pre-fabricated slab 10 such that the pre-fabricated slab 10 can be re-used.

Figure 9:
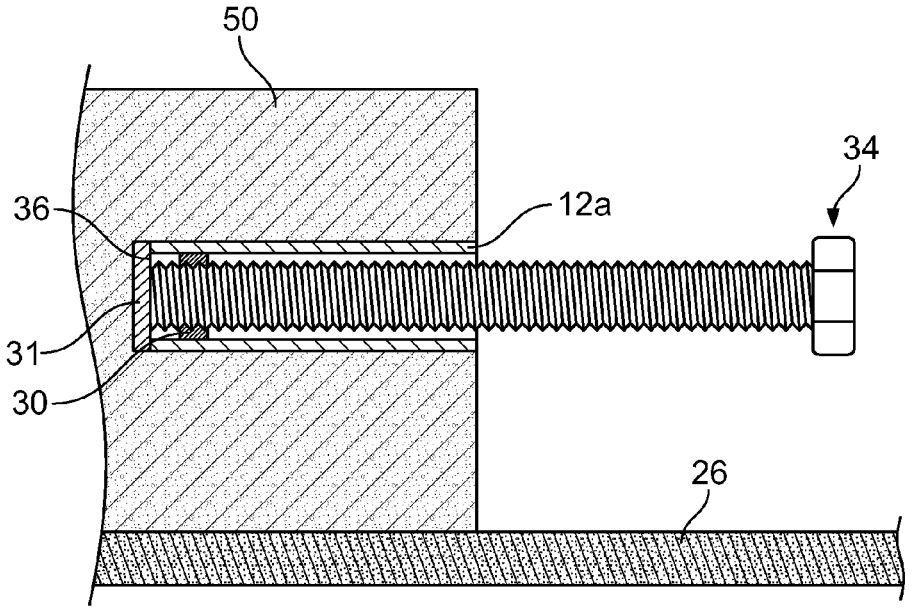
FIG. 9 depicts a cross-sectional view of a remaining portion of the dowel that remains embedded in the existing pavement after the adjacent pre-fabricated slab of FIG. 8 has been removed in accordance with the present disclosure.

Hereinafter, a description of the process of removing a pre-fabricated slab 10, which has been previously installed according to the description above, will be described. As depicted in FIG. 9, when the pre-fabricated slab 10 needs to be removed for repair of utilities under the slab 10, or other general repairs/replacement to the roadway near the slab 10, a cutting device, such as a concrete cutting saw, can be used to cut along the joint 32 at a depth at least as deep as the slab 10 is thick. Because the cutting device cuts through the entire thickness of the slab 10, the cutting device necessarily cuts through the connector 12*a*. Advantageously, by cutting through the connector 12*a* at approximately the gap 32, the connector 12*a* is cut such that one engagement component 30, or engagement surface, resides in the first cut half of the connector 12*a*, which resides in the roadway 50 and another engagement component 30, or engagement surface, resides in the second cut half of the connector 12*a*, which resides in the pre-fabricated slab 10. Moreover, by cutting through the connector 12*a*, the axial opening 13 is exposed at a relative center thereof on both the newly-formed first and second cut halves of the connector 12*a*. With the axial openings 13 exposed, access is granted to the engagement components 30 or the engagement surfaces within the opening 13 of the connector 12*a*. Accordingly, once the pre-fabricated slab 10 is vertically removed from its position adjacent the roadway 50, the hollow axial opening 13 in the half of the connector 12*a* in the existing roadway 50 is exposed such that the engagement component 30 is accessible.

Further in reference to FIG. 9, removal of the first half of the connector 12*a* embedded in the existing pavement 50 may be accomplished. Embodiments of the invention include the connector 12*a* having a smooth exterior surface, coated with a thin coating of bond breakers, to facilitate removal from the existing pavement 50. Embodiments of the connector 12*a* include the connector 12*a* being removed by gripping means, whether manual, pneumatic, or mechanical that grip the interior surface of the opening 13 and secure to the interior surface of the opening 13 such that the gripping means may be operated to remove the connector 12*a* from the pavement 50 without damaging or altering the structural integrity of the roadway 50 so that new full-size connectors 12*a* may be reinserted into the hole left by the removed half connector 12*a*. The bond breaker, described above, that was previously applied to the connector 12*a*, may facilitate in the removal of the connector 12*a* from the roadway 50.

With regard to the solid connector 12, embodiments of the connector 12 include the connector 12 having a shallow bore, or hole, drilled therein, after the connector 12 has been cut in half, such that the gripping means described above may grip and adhere to the shallow bore and provide that the gripping means may thereafter axially advance the connector 12 out of the roadway 50 without damaging or altering the structural integrity of the slab or roadway. The bond breaker, described above, that was previously applied to the connector 12 may facilitate in the removal of the connector 12 from the roadway 50. Boring the solid connector 12 to create a hole is laborious and removal of connector 12 by inserting conventional bolt extractor means in the bored hole is unreliable and time consuming. Thus, a hollow opening 13, such as that pre-configured in connector 12*a* is advantageous to the removal of the connector 12*a*.

Embodiments of the connector 12*a* include the connector 12*a* being removed by an engagement mechanism 34 that may be inserted into the axial opening 13 until the engagement mechanism 34 engages the engagement component 30 or the engagement surface. The engagement component 34 may be any device that corresponds to and is configured to releasably attach to the engagement component 30 or engagement surface within, or on, the connector 12*a*. For example, the engagement mechanism 34 may be a loop fixedly coupled within the opening 13 that may be engaged by the engagement component 30, which may be a hook. Further in example, the engagement mechanism 34 may be a spring-loaded anchor that expands when permitted, whereas the engagement component 30 may be a surface, such as a stepped ridge within the opening 13, i.e., the opening 13 having a smaller initial diameter and a larger trailing diameter, with the stepped ridge defined by the sudden change between diameters. Once the spring-loaded anchor is passed by the stepped ridge into the larger diameter, the anchor expands and is prevented from retreating out of the opening 13, thus securing the anchor within the opening 13. After which, the engagement mechanism 34 may be operated to apply axial force to the connector 12*a* to remove the connector 12*a* from the opening 13. The bond breaker previously applied to the connector 12*a* during installation may assist in the removal of the connector 12*a*.

In embodiments of the connector 12*a*, engaging the engagement component 30 or engagement surface comprises removably coupling the engagement mechanism 34 to the engagement component 30 or to the engagement surface, such that axial force may be applied to the connector 12*a* to remove the connector 12*a* from the slab 10 or roadway 50. In embodiments of the connector 12*a*, by operating the engagement mechanism 34, the engagement mechanism 34 may releasably engage the engagement component 30 or engagement surface, to thereby apply axial force to the connector 12*a* to remove the connector 12*a* from the existing slab 50. Embodiments of the connector 12*a* may include the engagement mechanism 34 being, for example, a threaded bolt that corresponds to the threads in engagement component 30 or on the internal surface of the opening 13, such that rotational force applied to the engagement mechanism 34 provides axial force to the internal surface of the opening 13, through the engagement of the corresponding threads on both the engagement mechanism 34 and the opening 13. Embodiments of the connector 12*a* may include the engagement mechanism 34 being, for example, a long coil-thread bolt that corresponds to the threads of the engagement component 30, such that rotational force applied to the engagement mechanism 34 provides axial force to the engagement component 30 through the engagement of the corresponding threads on both the engagement mechanism 34 and the engagement component 30.

Figure 10:
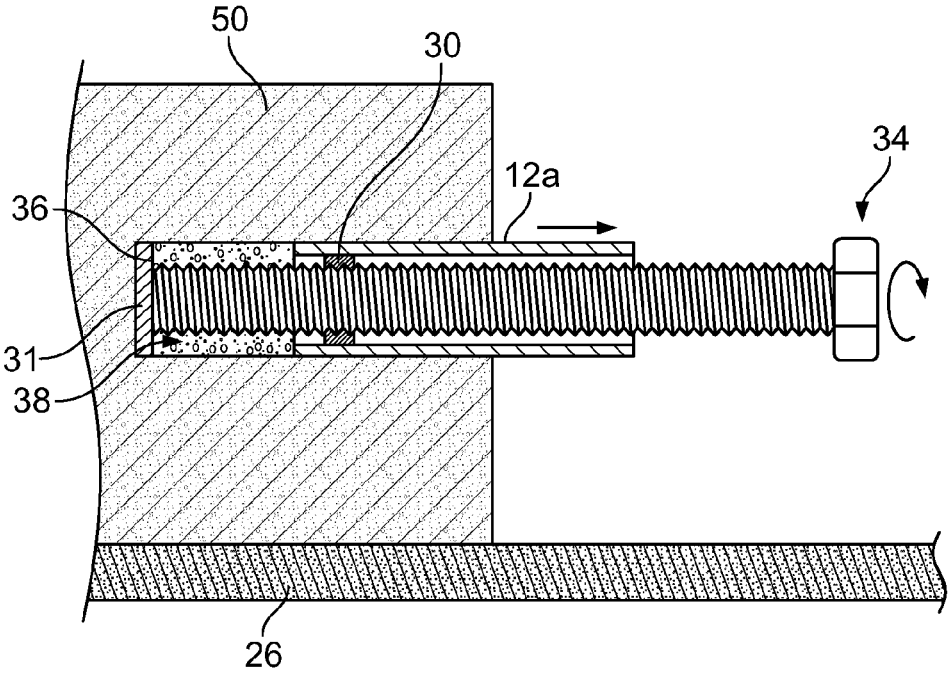
FIG. 10 depicts a cross-sectional view of the dowel in the process of being removed from the existing pavement in accordance with the present disclosure.

As depicted in FIG. 10, an exemplary embodiment of the connector 12*a* comprises the engagement mechanism 34 being operated, or otherwise rotated or twisted, into the threads of the engagement component 30. As such, the forces transmitted between the engagement mechanism 34 and the engagement component 30 cause the engagement mechanism 34 to advance through the engagement component 30 until the end of the engagement mechanism 34 contacts the cap 31 and presses the cap 31 against the existing slab 50 at a terminal end 36 of the space 38 occupied by the half connector 12*a*. Once the cap 31 and/or the engagement mechanism 34 contact the terminal end 36, the engagement mechanism 34 cannot continue to axially advance into the space 38. Thus, instead of the forces transmitted between the engagement mechanism 34 and the engagement component 30 causing the engagement mechanism 34 to advance, these forces cause the engagement component 30 to axially retreat, or otherwise withdraw, down the length of the engagement mechanism 34, as shown by the arrow in FIG. 10. Because the connector 12*a* is fixedly coupled to the engagement component 30, as the engagement component 30 withdraws down the axial length of the engagement mechanism 34, the half connector 12*a* withdraws out of, or is otherwise removed from, the existing pavement 50. The forces exerted on the connector 12*a* by the operation of the engagement mechanism 34 are greater than any bond or frictional restraint between the connector 12*a* and the existing pavement 50, thus breaking the bond between the connector 12*a* and the existing pavement 50 to allow the connector 12*a* to be removed.

Figure 11:
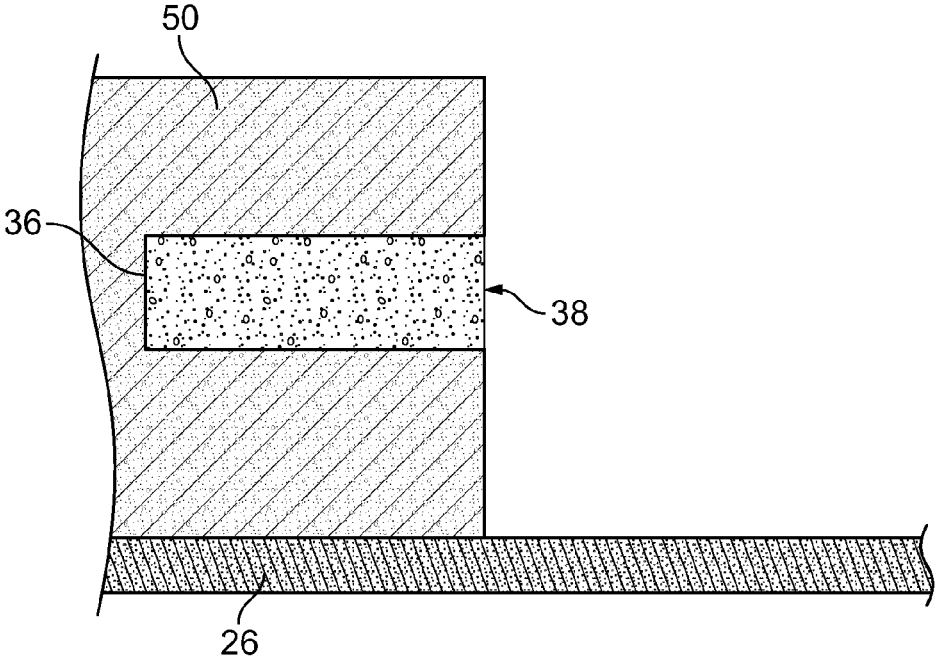
FIG. 11 depicts a cross-sectional view of the existing pavement after the dowel has been removed.
Figure 18:
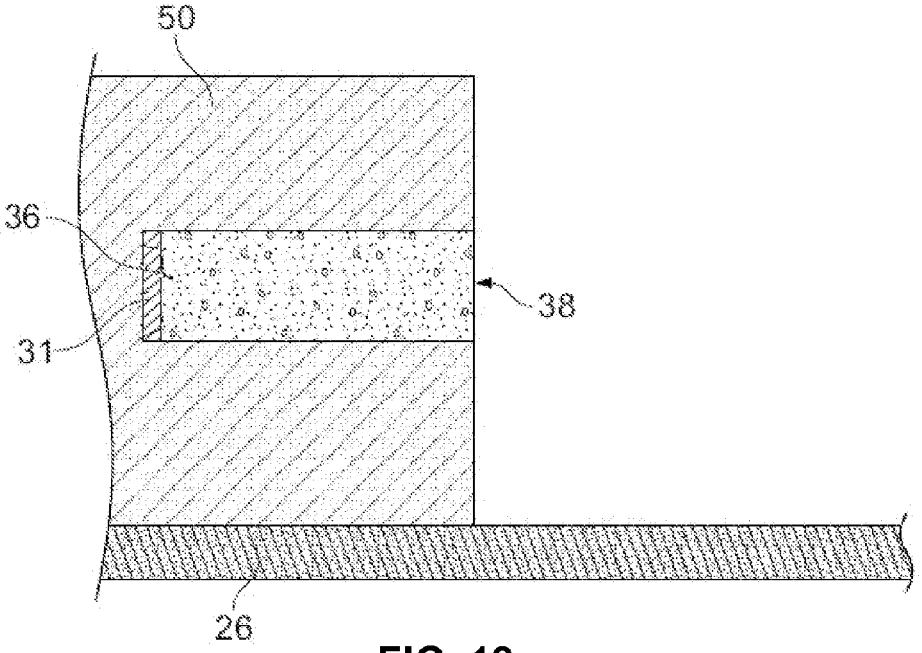
FIG. 18 depicts a cross-sectional view of the existing pavement after the dowel has been removed.

As depicted in FIG. 11, once the half connector 12*a* is completely removed from the existing pavement 50, a space 38 previously occupied by the half connector 12*a* is revealed. As depicted, the half connector 12*a* and the cap 31 have been removed from the space 38. However, as depicted in FIG. 18, the cap 31 may remain in the space 38 after the connector 12*a* has been removed therefrom. After removal of the connector 12*a*, another new and full-size replacement connector 12*a*, as depicted in FIG. 6, may be inserted and secured in the vacated space 38, using the binder material 17 described above, namely the epoxy resin. FIG. 7 illustrates how a full-size replacement connector 12*a* may appear once the full-size replacement connector 12*a* has been inserted and secured within the space 38. Once the full-size connector 12*a* is in place, the replacement slab 10 may be placed adjacent to the existing pavement 50, in accordance with the description above. The replacement slab 10 may be the same pre-fabricated slab 10 that was removed to do the repair, or, alternatively, the new replacement slab 10 may be an entirely new pre-fabricated slab 10.

As depicted in FIG. 14, in the case where the pre-fabricated slab 10 that was removed is to be re-used and replaced in the vacancy in the pavement 50 that was created by initially removing the same pre-fabricated slab 10, the pre-fabricated slab 10 should be prepared to be placed back in the vacancy. To do so, the pre-fabricated slab 10 must be cleaned. This requires that the other half of the connector 12*a* and the binder material 28 that yet remains in the removed slab 10 needs to be removed from the removed slab 10. To do so, the removed slab 10 can be inverted to place the removed slab 10 upside-down to provide more convenient access to the binder material 28. Although not shown inverted in FIG. 14, the process of removing the binder material 28 from the removed slab 10 is the same. An object such as a flat steel bar (not shown) can be forced into the position and space occupied by the foam spacer 33, such that the spacer 33 gives way to the object and the object is thereafter positioned between the removed slab 10 and the binder material 28 that encases the half connector 12*a*. Using a prying force, or other applied force, the binder material 28 can be axially advanced out of the interconnection slot 14 until the binder material 28, including the half connector 12*a* and the cap 31, is entirely removed from the interconnection slot 14. In addition, the binder material 28 positioned in the ports 16 can be removed therefrom by drilling, or otherwise removing, the binder material 28 out of the ports 16. Also, the foam spacer 33 that was damaged, crushed, or otherwise destroyed during removal of the binder material 28 may be removed and replaced with a new spacer foam 33.

As depicted in FIGS. 15 and 16, to facilitate removal of the binder material 28 from the removed slab 10, the interconnection slot 14 is tapered from front to back, as mentioned above. In particular, the width of the opening 14*c* at the edge of slab 10 of the interconnection slot 14 in the side face of the slab 10 is wider than the width of the terminal end 14*d* within the slab 10. As shown in FIG. 15, looking into the interconnection slot 14 from the side face of the slab 10, the tapered, and narrowing, vertical sides of the slot 14 are visible and are defined between the edges of the initial opening 14*c* and the edges of the terminal end 14*d*. At the very back of the slot 14 is positioned the foam spacer 33. As shown in FIGS. 15 and 16, the interconnection slot 14 is narrower at its back end than it is at its front end. Thus, the binder material 28 that is injected into the interconnection slot 14 is necessarily narrower at the terminal end 14*d* and wider at the initial opening 14*c*. Such a configuration makes it easier than it otherwise would be without tapered sides to axially advance the binder material 28 out of the interconnection port 14.

Once the binder material 28 has been removed from the interconnection slots 14 and from the accompanying ports 16, the removed, and now clean, slab 10 may be reinstalled in the roadway 50 from which it was taken. In other words, the removed slab 10 may be placed back in the portion of the roadway 50 from which it was removed. As described above and with reference again to FIG. 2, the "cleaned out" interconnection slots 14 of the removed slab 10, as depicted in FIG. 2, may be vertically placed over and lowered onto the connectors 12*a*, which have been inserted and secured within the spaces 38 in the existing pavement 50, such that the removed slab 10 is vertically replaced back in its original spot. Once in place, the binder material 28 can be re-injected into the ports 16 until the binder material 28 fills each of the interconnection ports 14 around the corresponding full-size connectors 12*a*.

Figure 12:
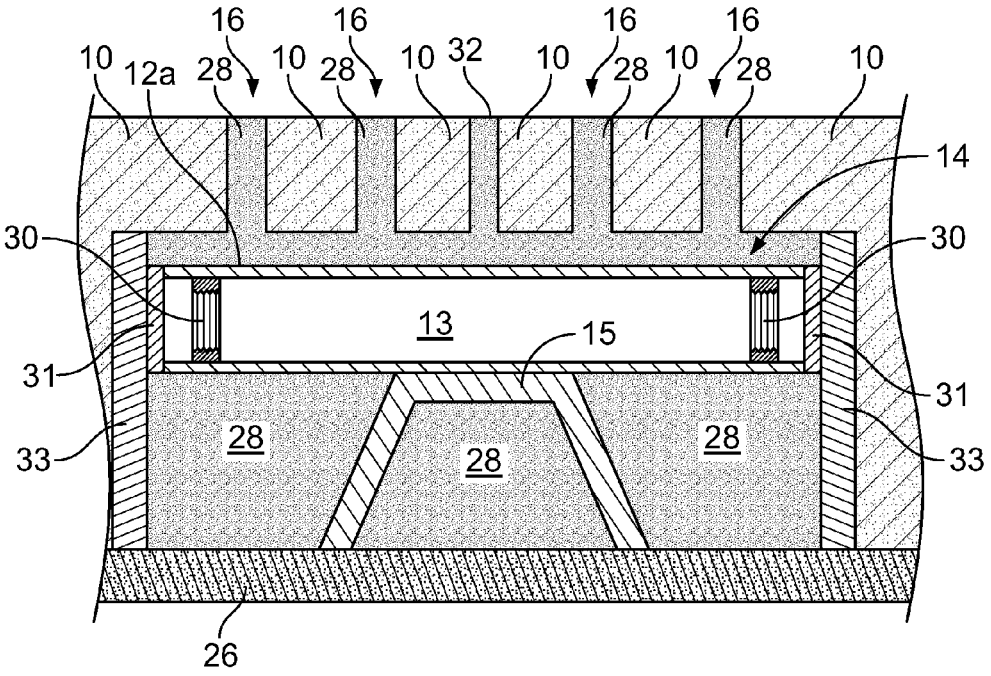
FIG. 12 depicts a cross-sectional view of the dowel partially embedded in each of two adjacent pre-fabricated slabs in accordance with the present disclosure.

As depicted in FIG. 12, in the case where two pre-fabricated slabs 10 are positioned adjacent one another over the subgrade 26 with the connector 12*a* supported on the support 15 therebetween, each of the respective interconnection ports 14 of the adjacent slabs 10 fit over and encompass a portion of the connector 12*a*. Thereafter, the binder material 28 is injected into the respective ports 16 until the binder material 28 fully occupies the interconnection ports 14 and surrounds the connector 12*a*. In this way, the connector 12*a* positioned between adjacent slabs 10 functions in the same way as the connector 12*a* positioned between the existing pavement 50 and the slab 10 described in detail above. In any configuration of the connector 12*a*, the connector 12*a* may have applied thereto the binder material 17 and/or the coating, each of which are described above, prior to insertion of the connector 12*a* into the existing pavement 50 or prior to the binder material 28 being injected thereon.

Figure 13:
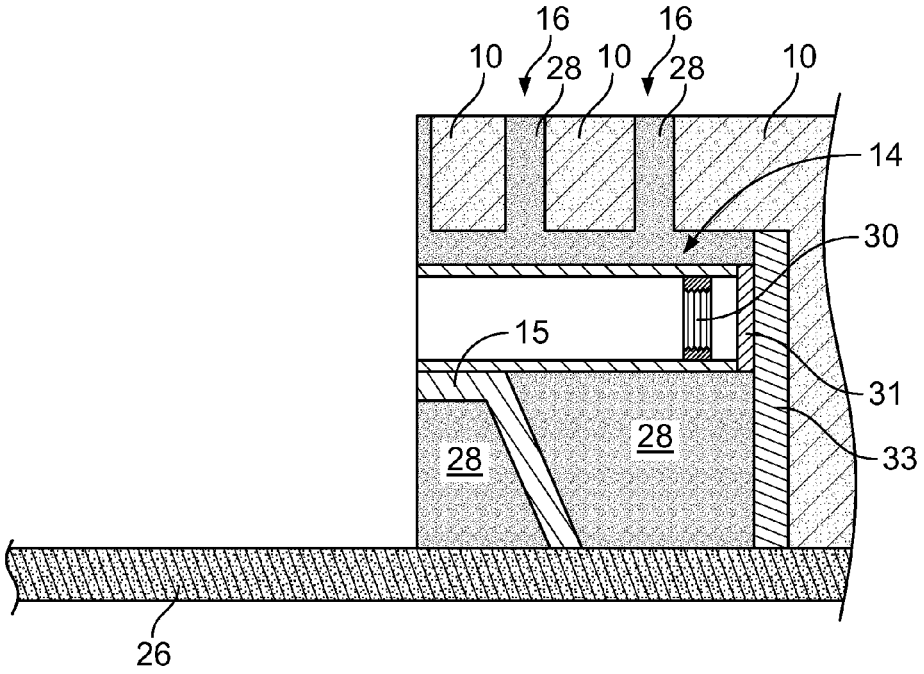
FIG. 13 depicts a cross-sectional view of a remaining portion of the dowel that remains embedded in the pre-fabricated slab after the other of the two adjacent pre-fabricated slabs of FIG. 12 has been removed in accordance with the present disclosure.

If after the adjacent slabs 10 are set in place, it becomes necessary to remove one or more of the adjacent slabs 10, a cut is made along the seam, or joint 32, created between the adjacent slabs 10 when assembled, to free the slab 10 from the adjacent slabs 10. As depicted in FIG. 13, one of the adjacent slabs 10 has been vertically removed from its location adjacent the other adjacent slab 10. However, each of the adjacent slabs 10 may be vertically removed from its original position prior to being set back in place. Before being set back in place, removal of the binder material 28 and the half connector 12*a* embedded therein from the interconnection port 14 must be performed, as described above. Thereafter, each of the adjacent slabs 10 may be vertically positioned back into their respective places on the subgrade 26 in the roadway 50, of course with a new, full-size connector 12*a* positioned therebetween on the support 15, as depicted in FIG. 3.

The above-described configuration provides for the quick and easy installation and replacement of the pre-fabricated slabs 10, by way of the efficient replacement of connectors 12*a*, which significantly reduces the time to completion of the repair, while at the same time reducing the labor expense.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A method of removing and replacing a pavement slab, the method comprising:

cutting between a pavement slab and an adjacent pavement slab, wherein the cutting cuts a hollow connector into first and second parts positioned in the pavement slab and the adjacent pavement slab, respectively;

vertically removing the adjacent pavement slab from next to the pavement slab to expose the first part of the hollow connector in the pavement slab;

removing the first part of the hollow connector from the pavement slab;

installing a full-size connector in the place of the first part of the hollow connector that was removed from the pavement slab; removing the second part of the connector from the adjacent pavement slab;

cleaning out the interconnection slot in the adjacent pavement slab; and replacing the adjacent pavement slab next to the pavement slab by vertically lowering the adjacent pavement slab next to the pavement slab until the interconnection slot in the adjacent pavement slab covers the full-size connector in the pavement slab.

2. The method of claim 1, wherein the removing the first part of the connector from the pavement slab further comprises:

inserting an engagement mechanism into an opening in the first part of the connector;

operating the engagement mechanism to remove the first part of the connector from the pavement slab without damaging the pavement slab.

3. The method of claim 1, wherein the installing a full-size connector in the place of the part of the connector in the pavement slab further comprises:

placing a binder material between the full-size connector and the pavement slab; and inserting the full-size connector into a space created in the pavement slab by the removal of the first part of the connector from the pavement slab.

4. The method of claim 1, wherein the replacing the adjacent pavement slab further comprises:

vertically lowering a new adjacent pavement slab next to the pavement slab until a interconnection slot in the new adjacent pavement slab covers the full-size connector in the pavement slab.

5. The method of claim 2, wherein the operating the engagement mechanism further comprises:

engaging an engagement component positioned in the central opening with the engagement mechanism.

6. The method of claim 5, wherein the engaging an engagement component positioned in the central opening with the engagement mechanism further comprises:

threading the engagement mechanism into corresponding threads of the engagement component on the first part of the connector such that the first part of the connector axially advances out of the pavement slab without damaging the pavement slab.

7. A system for removing a connector in pavement, the system comprising:

a pavement slab; and an adjacent pavement slab positioned next to the pavement slab; and a hollow connector, wherein a portion of the hollow connector is embedded in the pavement slab and a remaining portion is embedded in the adjacent pavement slab, wherein, under the condition that a cut is made between the pavement slab and the adjacent pavement slab, the hollow connector is cut into a first part in the pavement slab and a second part in the adjacent pavement slab, and wherein the adjacent pavement slab is configured to be vertically removed from next to the pavement slab, and Wherein the first part is axially advanced out of the pavement slab without deforming the pavement slab, thus defining a space in the pavement slab that is a shape of the removed first part.

8. The system of claim 7, wherein the first part is adapted to be removed from the pavement slab without damaging the pavement slab and the second part is adapted to be removed from the adjacent pavement slab without damaging the adjacent pavement slab.

9. The system of claim 7, wherein the adjacent pavement slab further comprises an interconnection slot that encompasses the second part of the connector.

10. The system of claim 9, wherein the interconnection slot is tapered from front to back.

11. The system of claim 9, wherein the interconnection slot is tapered from top to bottom.

12. The system of claim 9, wherein a binder material is inserted into the interconnection slot and around the connector to functionally bind the connector within the interconnection slot and thus functionally bind the connector to the adjacent pavement slab.

13. The system of claim 8, wherein a spacer is positioned between a rear surface of the interconnection port and a binder material, and wherein the spacer facilitates the removal of the second part from the adjacent pavement slab by easing the removal of the binder material out of the interconnection slot.

14. The system of claim 8, wherein a new full-size connector is inserted and secured within the space, such that a portion of the full-size connector is embedded in the pavement slab and a remaining portion is exposed, and wherein the adjacent pavement slab is vertically re-lowered next to the pavement slab and the interconnection slot of the adjacent pavement slab covers the remaining portion of the new full-size connector.

15. A method of replacing a connector in pavement, the method comprising:

cutting the pavement slab to a depth to cut a hollow connector in the pavement slab into first and second parts, the cutting the pavement slab defining first and second adjacent slabs;

removing the second adjacent slab having the second part contained therein from beside the first adjacent slab to define a void and thereby expose the first part of the hollow connector in the first adjacent slab;

removing the first part of the hollow connector from the first adjacent slab without otherwise damaging the first adjacent slab;

installing another connector in the first adjacent slab wherefrom the first part of the hollow connector was removed, the another connector extending from the first adjacent part into the void; and replacing the second adjacent slab in the void next to the first adjacent slab.

16. The method of claim 15, wherein the removing the first part of the connector from the first adjacent slab further comprises:

inserting an engagement mechanism into an opening in the first part of the hollow connector; and operating the engagement mechanism to remove the first part of the hollow connector from the first adjacent slab without damaging the first adjacent slab.

17. The method of claim 15, wherein the replacing the second adjacent slab in the void next to the first adjacent slab further comprises:

placing the second adjacent slab in structural communication with the another connector extending from the first adjacent slab; and fixedly engaging the second adjacent slab with the another connector.

* * * * *